US006229495B1

(12) United States Patent
Lopez et al.

(10) Patent No.: US 6,229,495 B1
(45) Date of Patent: May 8, 2001

(54) DUAL-POINT-FEED BROADBAND WHIP ANTENNA

(75) Inventors: Alfred R. Lopez, Commack; Richard J. Kumpfbeck, Huntington; John F. Pedersen, Northport, all of NY (US)

(73) Assignee: Bae Systems Advanced Systems, Greenlawn, NY (US)

( * ) Notice: Subject to any disclaimer, the term of this patent is extended or adjusted under 35 U.S.C. 154(b) by 0 days.

(21) Appl. No.: 09/369,778

(22) Filed: Aug. 6, 1999

(51) Int. Cl.[7] ..... H01Q 9/04
(52) U.S. Cl. ..... 343/791; 343/702
(58) Field of Search ..... 343/791, 790, 343/725, 702, 895, 878, 900, 901, 770, 768, 750, 728, 729, 767, 905; 455/550, 899

(56) References Cited

U.S. PATENT DOCUMENTS 4,916,457 * 4/1990 Foy et al. ..... 343/770
5,812,097 * 9/1998 Maldonado ..... 343/790
5,963,871 * 10/1999 Zhinong et al. ..... 455/550
5,977,928 * 11/1999 Ying et al. ..... 343/790
5,990,848 * 11/1999 Annamaa et al. ..... 343/895

* cited by examiner

*Primary Examiner*—Dong Wong
*Assistant Examiner*—Chuc D Tran
(74) *Attorney, Agent, or Firm*—Edward A. Onders; Kenneth P. Robinson

(57) ABSTRACT

A dual-radiator whip antenna to operate over a 30 to 450 MHz frequency band includes a high frequency dipole above a low frequency monopole. The outer conductor (30) of a coaxial line is configured to operate as a monopole. Above the upper terminus of the outer conductor, an extension **(32*a*) of the inner conductor (32) is configured as the upper arm of a dipole. An upper length of the outer conductor also functions as the lower dipole arm. With a single antenna port (13)**, a diplexer and other feed elements separate signals into high and low frequency bands respectively coupled to the dipole and monopole radiators. Increased high frequency range results from positioning of the center of radiation of the dipole above the monopole.

22 Claims, 3 Drawing Sheets

DUAL-POINT-FEED BROADBAND WHIP ANTENNA

RELATED APPLICATIONS (Not Applicable)

FEDERALLY SPONSORED RESEARCH (Not Applicable)

BACKGROUND OF THE INVENTION

This invention relates to antennas and, more particularly, broadband whip antennas providing improved performance.

The design and implementation of many varieties of whip antennas are well known. The general-usage dictionary definition of "a flexible radio antenna" encompasses the typical configuration of a base-supported flexible upright element of extended length. The *IEEE Standard Dictionary of Electrical and Electronic Terms* is more specific in its reference to "a thin flexible monopole antenna". Prior types of whip antennas are suitable for many applications, subject to inherent limitations such as range of coverage and usable frequency band for an individual antenna design.

Objects of the present invention are, therefore, to provide new and improved whip antennas and such antennas having one or more of the following characteristics and advantages

- 15:1 bandwidth (e.g., 30 to 450 MHz);
- broadband dual radiator construction, dipole above monopole;
- dual-point-feed, bands separated for dipole and monopole;
- elevated, high frequency dipole for increased range;
- coaxial construction, with outer conductor forming low frequency monopole;
- coaxial high and low band radiators;
- dipole above monopole in single elongated radome;
- single port input/output at antenna base;
- diplexed feeds to high and low band radiators;
- simplified, low cost construction; and
- readily mountable on a vehicle or other support structure.

SUMMARY OF THE INVENTION

In accordance with the invention, a dual-radiator whip antenna includes a vertically-extending concentric structure. An outer element circumferentially surrounds an inner conductor, with the outer element configured to provide a first radiating element (monopole) operable over a first frequency band. The inner conductor has an upper extension extending vertically beyond the upper terminus of the outer element, with the upper extension configured to provide a second radiating element (dipole) operable over a second frequency band. A feed configuration is arranged to couple first signals within the first frequency band to the outer element and couple second signals within the second frequency band to the upper extension. The feed configuration may include: a diplexer coupled to an antenna port to separate signals into first signals at a first diplexer port and second signals at a second diplexer port; a lower feed circuit at the base of the antenna to couple signals from the first diplexer port to the outer element and signals from the second diplexer port to the inner conductor; and an upper feed circuit coupled between the upper terminus of the outer element and the upper extension of the inner conductor to excite the second radiating element.

For a better understanding of the invention, together with other and further objects, reference is made to the accompanying drawings and the scope of the invention will be pointed out in the accompanying claims.

DESCRIPTION OF THE INVENTION

Figure 1:
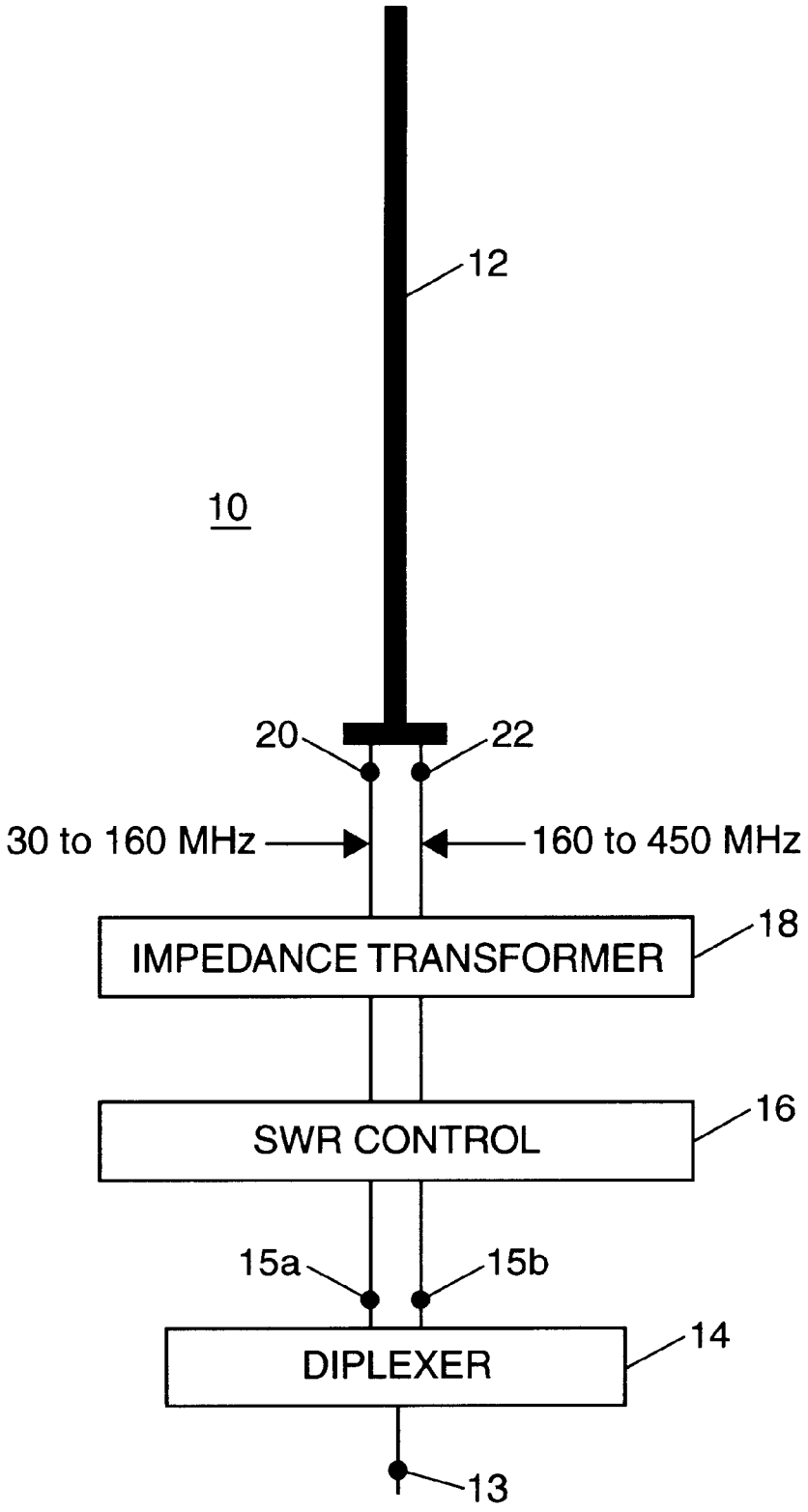
FIG. 1 is an external view of a form of dual-radiator whip antenna pursuant to the invention, including block diagram representation of feed configuration elements.

FIG. 1 is an external view of an embodiment of a dual-radiator whip antenna 10 pursuant to the invention. This antenna was designed to cover a 15:1 bandwidth for radiation and reception of signals over a frequency range of 30 to 450 MHz. The antenna 10 includes a base-mounted vertically-extending concentric structure 12, which in FIG. 1 is covered by a weather-resistant, radiation-transmissive covering (e.g., a radome of generally circular cylindrical shape). As will be described, radome 12 houses vertically-stacked first and second radiating elements. Antenna 10 also includes a feed configuration comprising units 14, 16 and 18 visible in FIG. 1, as well as additional components, such as lower and upper feed circuits, to be addressed below.

Diplexer 14 is a frequency diplexer coupled to antenna port 13 and arranged to separate input signals into first signals (e.g., signals in a first frequency band of 30 to 160 MHz) provided at first diplexer port 15*a* and second signals (e.g., signals in a second frequency band of 160 to 450 MHz) provided at second diplexer port 15*b*. SWR control unit 16 is provided to improve antenna standing wave ratio (SWR) characteristics by introducing appropriate frequency-dependent signal attenuation and may include separate sections (one for each of the frequency bands) connected respectively to ports 15*a* and 15*b*. Impedance transformer unit 18 is provided to improve impedance matching and may include separate transformer sections (one for each of the first and second radiating elements) coupled respectively to ports 15*a* and 15*b*, via unit 16 as shown. In this configuration, unit 18 is also coupled to the radiating elements via terminals 20 and 22 and feed circuits to be further described. Once having an understanding of the invention, units 14, 16 and 18 can be provided by skilled persons using existing technology or, in some applications, one or more of these units may be omitted as unnecessary.

Figure 2:
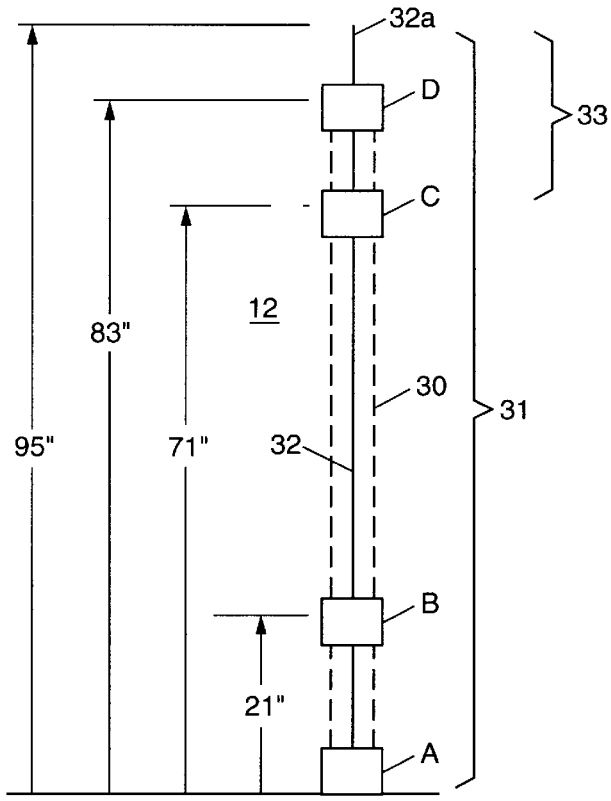
FIG. 2 is a conceptual diagram of the FIG. 1 whip antenna, with circuit representations of portions thereof included in FIGS. 2A, 2B, 2C and 2D.

FIG. 2 is a conceptual diagram of the FIG. 1 antenna with the radome and units 14, 16 and 18 removed. On an overview basis, the vertically-extending concentric structure 12 has the form of a coaxial transmission line section (e.g., section of coaxial cable) including an outer conductor 30 and inner conductor 32. Outer conductor 30 extends to a height of 83 inches above the base in this example (all lengths stated approximately) and is utilized as a monopole radiating element over the first frequency band of 30 to 160 MHz. Inner conductor 32 extends through outer conductor 30 to a height of 83 inches and has an upper extension 32*a* reaching a height of 95 inches. As will be described, upper extension 32*a* is configured for operation as a dipole utilizing upper extension 32*a* as an upper dipole arm and the upper length of outer conductor 30 (its length extending between the 71 and 83 inch heights) as a lower dipole arm. Upper extension 32*a* may be an exposed section of coaxial cable inner conductor or other appropriate conductive member. Operationally, the effective length 31 of the monopole first radiator comprising outer conductor 30 will typically include upper extension 32*a* (which is radiation excited in monopole operation, in this embodiment) and thereby extend to an approximate height of 95 inches. Also, operationally the effective length 33 of the dipole second radiator comprising upper and lower dipole arms, as described, will have an approximate length of 24 inches, extending from 71 to 95 inches above the base. The center of radiation for the dipole element will thus be elevated 83 inches above the base of the antenna, providing increased coverage (e.g., 6 dB gain improvement over a dipole mounted at antenna base level). With this construction, the dipole element operates essentially independently of any ground plane (vehicle or other surface) above which the antenna extends.

As shown in FIG. 2, the dual-radiator whip antenna comprises a vertically-extending concentric structure in the form of a coaxial transmission line section (e.g., a section of coaxial cable of suitable characteristics) with cylindrical outer conductor 30 shown dashed and inner conductor 32. Conductor 30 is an outer element circumferentially surrounding inner conductor 32, with element 30 configured to provide a first radiating element (i.e., a monopole) operable over a first frequency range of 30 to 160 MHz in this example. Conductor 32 has an upper extension 32*a* extending above the upper terminus (i.e., terminus at height 83 inches) of outer element 30. The upper extension 32*a* is configured to provide a second radiating element (i.e., a dipole) operable over a second frequency range of 160 to 450 MHz in this example. As already noted, upper extension 32*a* functions as an upper dipole arm and the upper length of conductor 30 between heights of 71 and 83 inches functions as a lower dipole arm.

Figure 2A:
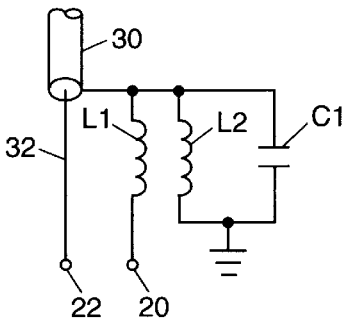

FIGS. 2A, 2B, 2C and 2D are simplified circuit representations of portions of the FIG. 2 antenna. FIG. 2A illustrates a lower feed circuit in the form of a dual feed/choke circuit used at block A at the base of the FIG. 2 antenna. Terminal 22 couples high frequency signals in the 160 to 450 MHz second frequency range (provided by diplexer 14, see FIG. 1) to the inner element 32. Terminal 20 couples low frequency signals in the 30 to 160 MHz first frequency range (provided by diplexer 14) to the outer element 30 via inductance Li. While the outer conductor 30 is coupled to reference potential or ground via the parallel C1/L2 circuit, that circuit has reactance values selected to perform as a choke isolating the 30 to 160 MHz signals from ground. The lower feed circuit of FIG. 2A is thus effective to couple signals from the first diplexer port 15*a* to the outer element 30 (via terminal 20) and signals from the second diplexer port 15*b* to the inner element 32 (via terminal 22).

Figure 2B:
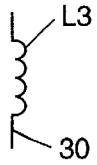
Figure 2C:
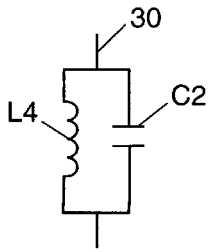
Figure 2D:
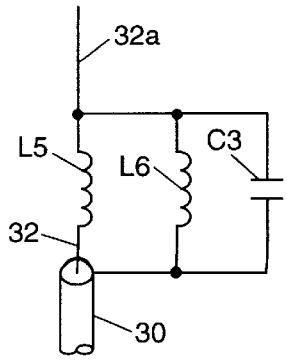

FIG. 2D illustrates an upper feed circuit coupled between the upper terminus of the outer element 30 and the upper extension 32*a* of inner conductor 32, at block D in FIG. 2, to excite the second radiating element. As shown, the 160 to 450 MHz second frequency range signals are coupled from inner conductor 32 to upper extension 32*a* via inductance L5. Upper extension 32*a* is referenced to outer conductor 30 via the parallel L6/C3 circuit, which acts as a double tuning circuit for improved performance over the 160 to 450 MHz band. The upper feed circuit of FIG. 2D is thus effective to provide excitation of upper extension 32*a* for operation as a dipole constituted as previously discussed.

The FIG. 2, configuration also includes, at block B, an inductance L3 shown in FIG. 2B which is provided as a tuning inductance to improve performance of the monopole element 30 over the first frequency band. Included at block C is a parallel C2/L4 circuit shown in FIG. 2C, which acts as a high frequency choke helping to define the lower dipole arm by isolating the 160 to 450 MHz signals from the portion of outside conductor 30 existing below block C in FIG. 2, while not preventing passage of low frequency signals. In this antenna design, the FIGS. 2B and 2C circuits are positioned at approximately 21 and 71 inches, respectively, above base level. Appropriate reactance values for the capacitances and inductances shown in FIGS. 2A, 2B, 2C and 2D can be specified by skilled persons having an understanding of the invention. Exemplary values are provided below.

Figure 3:
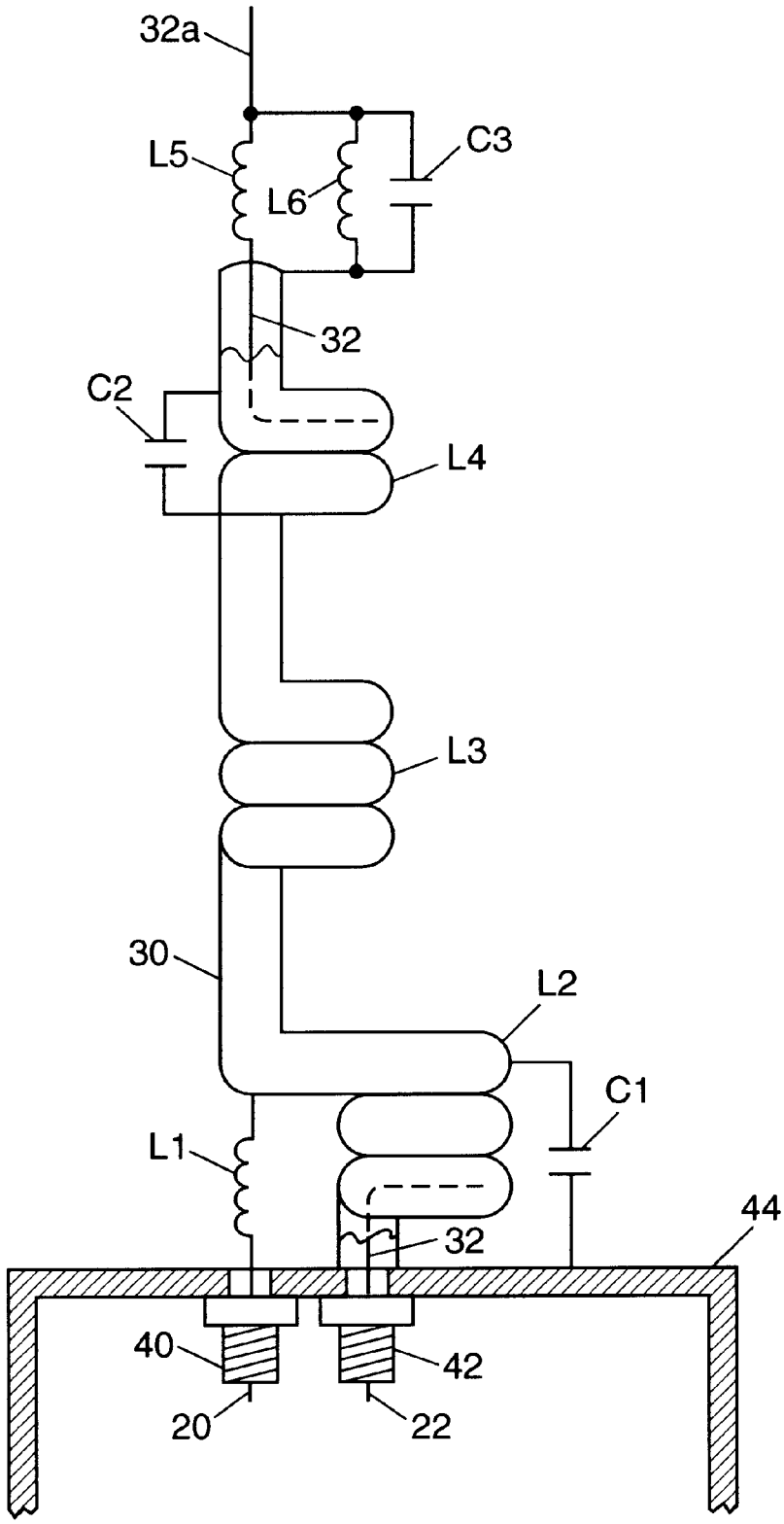
FIG. 3 shows a coaxial transmission line formed to provide basic portions of the FIG. 1 antenna, with inclusion of circuit elements represented pursuant to FIGS. 2, 2A, 2B, 2C and 2D.

Referring now to FIG. 3, there is shown a representation of an antenna implementation pursuant to the invention, wherein a section of coaxial cable is formed to provide certain of the circuit elements discussed with reference to FIG. 2. As illustrated, coaxial connectors 40 and 42 are mounted to a portion of a mechanical configuration 44 at the base of the antenna 10, which is arranged to enable the antenna to be mounted in an upright alignment and may also house units 14, 16 and 18 of FIG. 1. The inner conductor of connector 40 represents terminal 20 of FIGS. 1 and 2, and is shown coupled to the outer conductor 30 via a discrete component inductor L1, which may be soldered in place. The inner conductor of connector 42 represents terminal 22 of FIGS. 1 and 2A, and connects directly to the inner conductor 32 of the coaxial cable. As represented in FIG. 3, a portion of the coaxial cable is coiled to provide inductance L2 between the upper part of outer conductor 30 and ground (unit 44) and the C1/L2 choke is completed by inclusion of a discrete capacitor C1 connected across the L2 coil to ground or reference potential.

Inductances L3 and L4, as shown in FIG. 3, are provided by similarly coiling a portion of the coaxial cable to provide an inductance along the outer conductor 30. As will be appreciated, once the extent of physical coiling is empirically determined to provide suitable inductances for a particular antenna design, production antennas can readily and economically be fabricated. Coiling of the coaxial cable to provide the desired conductor 30 inductances, will also result in coiling of the inner conductor contained within the cable. However, as shown, there are no capacitances added with respect to the inner conductor and the overall effect on transmission of the high frequency signals within the coaxial cable from terminal 22 will not prevent the desired operation of the upper dipole element as previously described.

With respect to block D of the FIG. 2 antenna, reactances L5, L6 and C3 are provided in discrete component or other appropriate form at the base of upper extension 32*a* as shown in FIG. 3. As discussed, a cylindrical radome will typically be included to encompass and support the antenna when provided in a FIG. 3 or other configuration.

Based on computer analysis, with an antenna as described mounted on a vehicle at a point 14 feet above the ground, projected operating results were as follows for reception from a 100 watt transmitter at a distance of 30 Km. Received power level at the antenna port 13 was indicated at about −125 dBm across the 30 to 160 MHz band and about −100 dBm across the 160 to 450 MHz band. As previously noted, increased coverage in the upper frequency band is provided as a result of the raised position of the high frequency dipole element above the low frequency monopole element. With reference to FIGS. 2A, 2B, 2C and 2D, in this antenna design reactance values were as follows: L1, 0.15 $\mu$H; L2, 1.00 $\mu$H; L3, 0.20 $\mu$H; L4, 20.0 $\mu$H; L5, 0.02 $\mu$H; L6, 0.20

μH; C1, 3.13 pF; C2, 0.088 pF; and C3, 0.62 pF. A section of flexible coaxial cable with a braided outer conductor and a characteristic impedance of 50 Ohms was used to provide the concentric elements.

While there have been described the currently preferred embodiments of the invention, those skilled in the art will recognize that other and further modifications may be made without departing from the invention and it is intended to claim all modifications and variations as fall within the scope of the invention.

What is claimed is:

1. A dual-radiator whip antenna, comprising:

a vertically-extending concentric structure including an outer element circumferentially surrounding an inner conductor, said outer element configured to provide a first radiating element operable over a first frequency band, the inner conductor having an upper extension in a fixed position extending vertically beyond the upper terminus of the outer element, said upper extension configured to provide a second radiating element operable over a second frequency band; and a feed configuration to couple first signals within the first frequency band to said outer element and couple second signals within the second frequency band to said upper extension, to permit simultaneous use of said first and second radiating elements, the feed configuration including a diplexer coupled to an antenna port to separate signals into said first signals at a first diplexer port and said second signals at a second diplexer port, a lower feed circuit at the base of said antenna to couple signals from the first diplexer port to said outer element and signals from the second diplexer port to said inner conductor, and an upper feed circuit coupled between the upper terminus of the outer element and the upper extension of the inner conductor to excite said second radiating element.

2. A dual-radiator whip antenna as in claim 1, wherein said outer element is configured to form a monopole radiating element and said upper extension is configured to form a dipole radiating element comprising said upper extension and an upper length of said outer element.

3. A dual-radiator whip antenna as in claim 1, wherein said concentric structure comprises a section of coaxial transmission line.

4. A dual-radiator whip antenna as in claim 3, wherein said concentric structure additionally provides at least one inductance comprising a coiled portion of said coaxial transmission line.

5. A dual-radiator whip antenna as in claim 1, wherein said feed configuration additionally includes impedance transformer sections to improve impedance matching to said outer element and inner conductor.

6. A dual-radiator whip antenna as in claim 1, wherein said feed configuration additionally includes frequency dependent signal attenuation sections to improve standing wave ratio characteristics affecting signal transmission.

7. A dual-radiator whip antenna as in claim 1, additionally comprising a mechanical configuration at the base of the antenna to enable the antenna to be mounted in an upright alignment.

8. A dual-radiator whip antenna as in claim 1, additionally comprising a weather-resistant, radiation-transmissive covering encompassing the outer element and upper extension of the inner conductor.

9. A dual-radiator whip antenna as in claim 1, wherein the first radiating element is configured for operation over a 30 to 160 MHz band and the second radiating element is configured for operation over a 160 to 450 MHz band.

10. A dual-radiator whip antenna, comprising:

a vertically-extending concentric structure including an outer element at least partially surrounding an inner conductor, said outer element configured to provide a first radiating element operable over a first frequency band, the inner conductor having an upper extension in a fixed position extending vertically beyond the upper terminus of the outer element, said upper extension configured to provide a second radiating element operable over a second frequency band; and a feed configuration to couple first signals within the first frequency band to said outer element and couple second signals within the second frequency band to said upper extension of the inner conductor, to permit simultaneous use of said first and second radiating elements.

11. A dual-radiator whip antenna as in claim 10, wherein said outer element is configured to form a monopole radiating element and said upper extension is configured to form a dipole radiating element comprising said upper extension and an upper length of said outer element.

12. A dual-radiator whip antenna as in claim 10, wherein said feed configuration includes an upper feed circuit coupled between the upper terminus of the outer element and the upper extension of the inner conductor to excite said second radiating element.

13. A dual-radiator whip antenna as in claim 12, wherein said feed configuration includes a lower feed circuit to couple said first signals to said outer element and couple said second signals to the inner conductor.

14. A dual-radiator whip antenna as in claim 10, wherein said vertically-extending concentric structure comprises a section of coaxial transmission line.

15. A dual-radiator whip antenna as in claim 14, wherein said concentric structure additionally provides at least one inductance comprising a coiled portion of said coaxial transmission line.

16. A dual-radiator whip antenna as in claim 10, wherein the inner conductor extends through the outer element over the length of the outer element and said upper extension is an extension of the inner conductor having a length suitable for operation, in cooperation with an upper length of the outer element, as a dipole radiator at frequencies within the second frequency band.

17. A dual-radiator whip antenna as in claim 16, wherein the outer element has a length suitable for operation as a monopole radiator at frequencies within the first frequency band.

18. A dual-radiator whip antenna as in claim 10, wherein said feed configuration includes a diplexer to separate signals input at an antenna port into first frequency band signals provided at a first diplexer port and second frequency band signals provided at a second diplexer port.

19. A dual-radiator whip antenna as in claim 18, wherein said feed configuration is arranged to couple signals from the first diplexer port to said outer element and signals from the second diplexer port to said upper extension of the inner conductor.

20. A dual-radiator whip antenna as in claim 18, wherein said feed configuration includes a lower feed circuit to couple signals from the first diplexer port to said outer element and signals from the second diplexer port to said inner conductor, and an upper feed circuit coupled between the upper terminus of the outer element and the upper extension of the inner conductor for excitation of said second radiating element.

21. A dual radiator whip antenna, comprising:

a vertically-extending concentric structure including an outer element circumferentially surrounding an inner conductor, said outer element configured to provide a first radiating element operable over a first frequency band, the inner conductor having an upper extension extending vertically beyond the upper terminus of the outer element, said upper extension configured to provide a second radiating element operable over a second frequency band; and a feed configuration to couple first signals within the first frequency band to said outer element and couple second signals within the second frequency band to said upper extension, the feed configuration including a diplexer coupled to an antenna port to separate signals into said first signals at a first diplexer port and said second signals at a second diplexer port, a lower feed circuit at the base of said antenna to couple signals from the first diplexer port to said outer element and signals from the second diplexer port to said inner conductor, and an upper feed circuit coupled between the upper terminus of the outer element and the upper extension of the inner conductor to excite said second radiating element;

said outer element configured to for a monopole radiating element and said upper extension configured to form a dipole radiating element comprising said upper extension and an upper length of said outer element; and the outer element including, below said upper length, a choke circuit to improve isolation of second frequency band signals from transmission along said outer element below said upper length thereof.

22. A dual-radiator whip antenna, comprising:

a vertically-extending concentric structure including an outer element at least partially surrounding an inner conductor, said outer element configured to provide a first radiating element operable over a first frequency band, the inner conductor having an upper extension extending vertically beyond the upper terminus of the outer element, said upper extension configured to provide a second radiating element operable over a second frequency band; and a feed configuration to couple first signals within the first frequency band to said outer element and couple second signals within the second frequency band to said upper extension of the inner conductor;

said outer element configured to form a monopole radiating element and said upper extension configured to form a dipole radiating element comprising said upper extension and an upper length of said outer element; and the outer element including, below said upper length, a choke circuit to improve isolation of second frequency band signals from transmission along said outer element below said upper length thereof.

* * * * *